US006338703B1

(12) United States Patent
Yu

(10) Patent No.: US 6,338,703 B1
(45) Date of Patent: Jan. 15, 2002

(54) SLIDING EXERCISER

(75) Inventor: Hui-Nan Yu, Taoyuan (TW)

(73) Assignee: Sam TSAI (TW); a part interest ( * ) Notice: Subject to any disclaimer, the term of this patent is extended or adjusted under 35 U.S.C. 154(b) by 0 days.

(21) Appl. No.: 09/715,055

(22) Filed: Nov. 20, 2000

(51) Int. Cl.[7] ..... A63B 21/00
(52) U.S. Cl. ..... 482/132; 482/140; 482/127
(58) Field of Search ..... 482/140, 132, 482/127, 904, 907, 116, 126, 121

(56) References Cited

U.S. PATENT DOCUMENTS 6,017,296 A * 1/2000 Tang et al. ..... 482/132
6,146,318 A * 11/2000 Kuo ..... 482/132
6,174,269 B1 * 1/2001 Eschenbach ..... 482/132
6,254,518 B1 * 7/2001 Yu ..... 482/140
6,264,587 B1 * 7/2001 Lee ..... 482/132

* cited by examiner

*Primary Examiner*—Stephen R. Crow
(74) *Attorney, Agent, or Firm*—Troxell Law Office PLLC

(57) ABSTRACT

A sliding exerciser includes a body unit equipped with a front castor and a transversely extended top handle, and a damping unit, the damping unit including a revolving shaft disposed in parallel to the wheel axle, an elastic cord member coupled to the revolving shaft, two wheels, a wheel axle coupled between the wheel and adapted to alternatively roll up and release the elastic cord member when the user pushes and pull the sliding exerciser on a flat surface.

1 Claim, 5 Drawing Sheets

SLIDING EXERCISER

BACKGROUND OF THE INVENTION

The present invention relates to exercising apparatus and, more particularly, to a sliding exerciser, which is portable.

Various exercising apparatus have been disclosed, and have appeared on the market. These conventional exercising apparatus are commonly heavy and expensive. There is known a sliding exerciser adapted for reciprocating on a flat surface. This structure of sliding exerciser has wheels for moving on a flat surface, and damping means adapted to give a damping resistance when the user moves the sliding exerciser. However, this structure of sliding exerciser is not satisfactory in function. When the user moves the sliding exerciser, it may deviate from course. Keeping the sliding exerciser in balance requires a special skill. It is dangerous to a non-experience person to use this structure of sliding exerciser.

SUMMARY OF THE INVENTION

It is one object of the present invention to provide a sliding exerciser, which is compact and portable. It is another object6 of the present invention to provide a sliding exerciser, which is simple and detachable. According to one aspect of the present invention, the sliding exerciser comprises a body unit for sliding on a flat surface, and a damping unit installed in the body unit and adapted to impart a damping resistance to the body unit when the user moves the body unit on a flat surface. According to another aspect of the present invention, the damping unit comprises an elastic cord member, which is rolled up to impart a damping resistance when the user moves the sliding exerciser forwards, or released when the user moves the sliding exerciser backwards.

DETAILED DESCRIPTION OF THE PREFERRED EMBODIMENT

Figure 1:
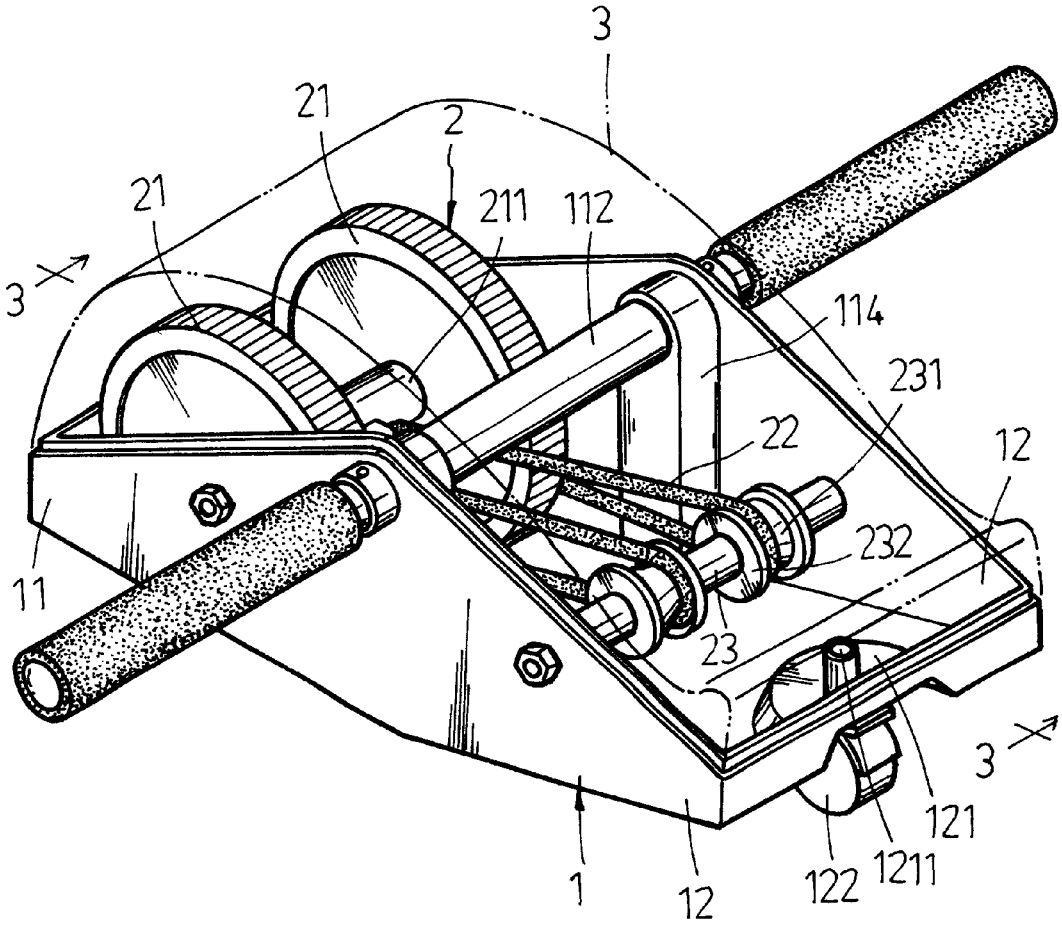
FIG. 1 is an elevational view of a sliding exerciser according to the present invention.
Figure 2:
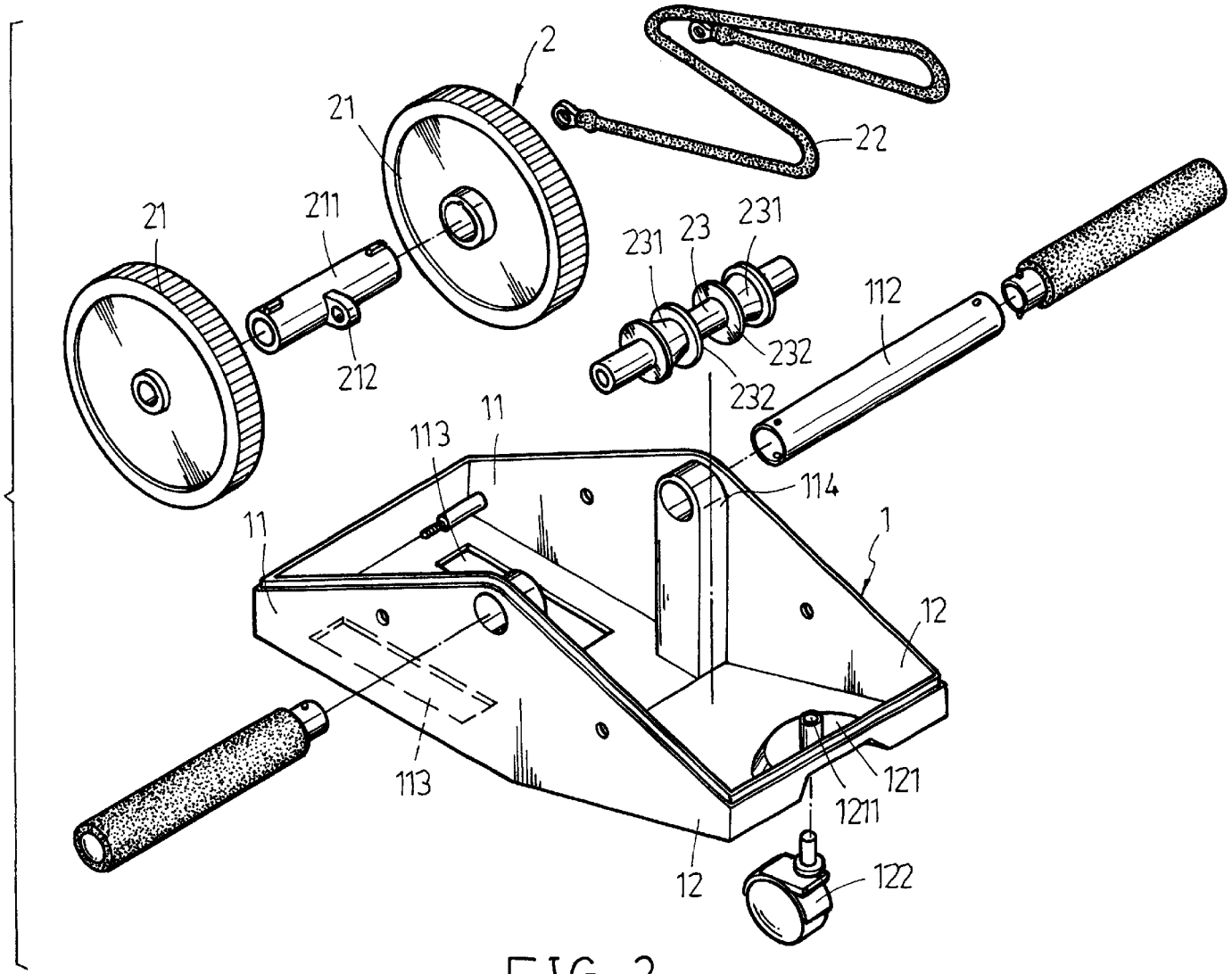
FIG. 2 is an exploded view of the sliding exerciser shown in FIG. 1.
Figure 3:
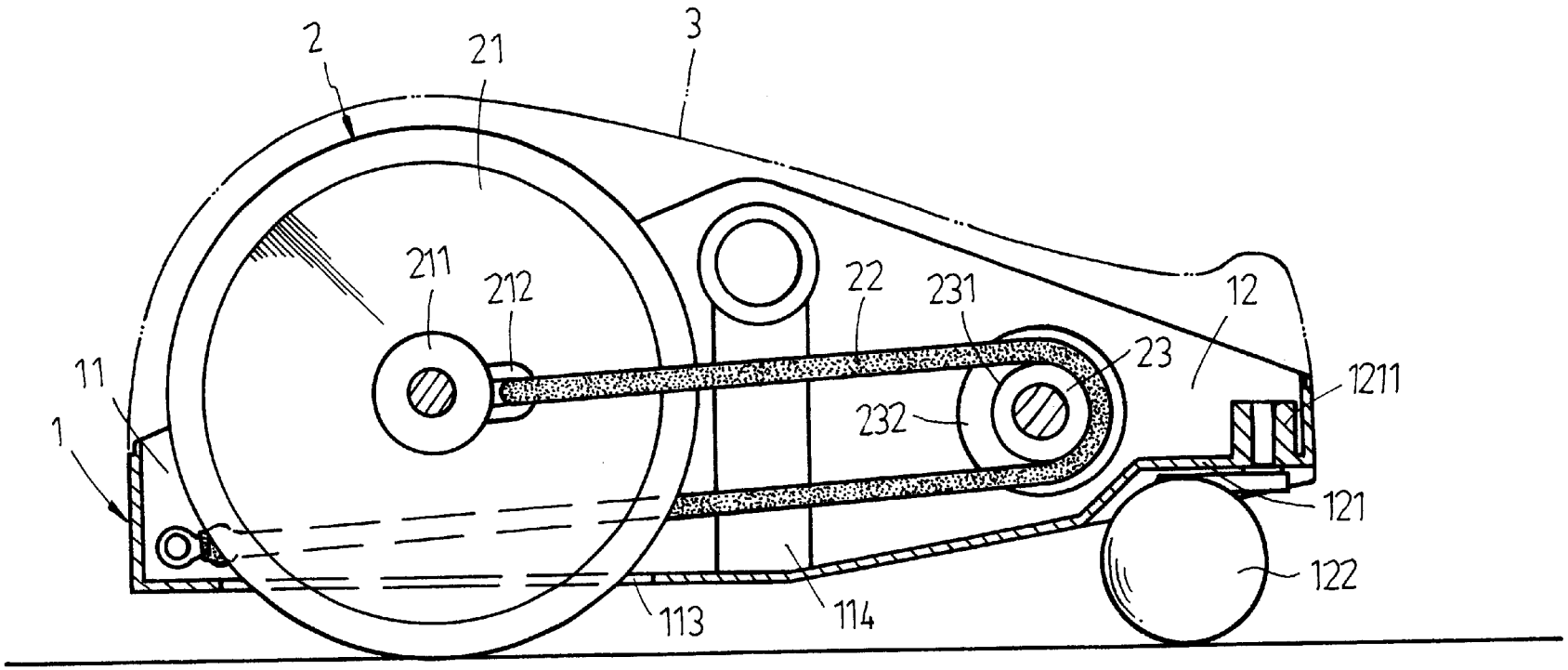
FIG. 3 sectional view taken along line 3—3 of FIG. 1.

Referring to FIGS. from 1 through 3, a sliding exerciser in accordance with the present invention is generally comprised of a body unit 1, and a damping unit 2. The body unit 1 is covered with a covering 3, having a front part 11 and a rear part 12. The front part 11 of the body unit 1 comprises two parallel bottom slots 113, two upright pots 114, and a transverse handle 112 fastened to the upright posts 114. The rear part 12 of the body unit 1 comprises a front wheel holder 121, and a castor 122 coupled to an axle bearing 1211 of the wheel holder 121 and adapted to support the front part 12 for enabling the sliding exerciser to be moved on a flat surface. The damping unit 2 comprises two wheels 21 respectively rotated in the slots 113 and protruding the bottom side wall of the housing 1, a wheel axle 211 coupled between the wheels 21, the wheel axle 211 having an eyed lug 212 on the middle, a revolving shaft 23 transversely coupled between two upright side walls of the rear part 12 of the body unit 1, and an elastic cord member 22 coupled between the wheel axle 211 and the revolving shaft 23. The revolving shaft 23 comprises two reversed conical wheels 231, and collars 232 rose around the periphery at two sides of each conical wheel 231. The elastic cord member 22 is inserted through the eyed lug 212 of the wheel axle 211 and turned round the conical wheels 231, having two distal ends respectively fastened to the front part 11 of the body unit 1 at two sides.

Figure 4:
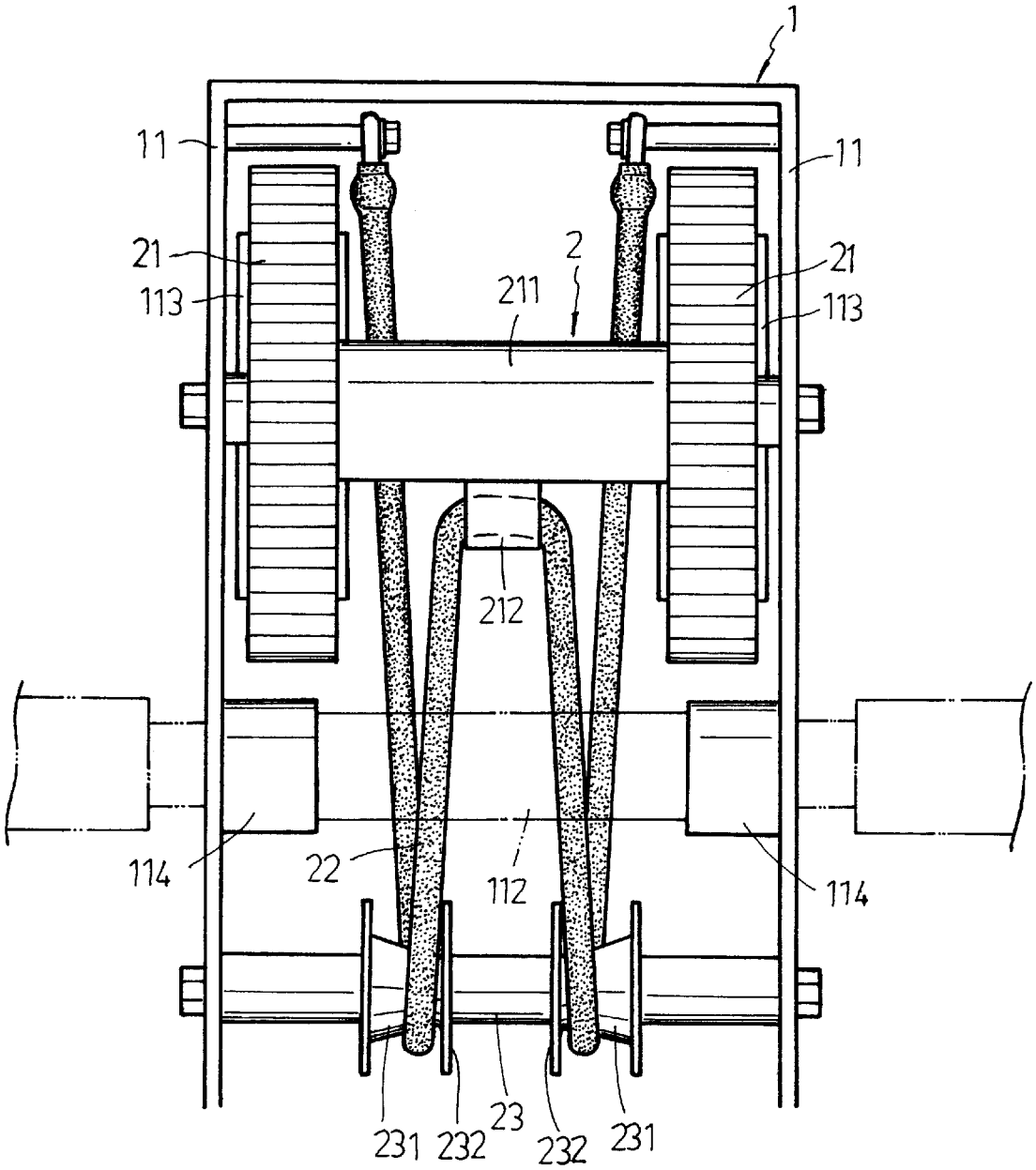
FIG. 4 is a top view of FIG. 1.
Figure 5:
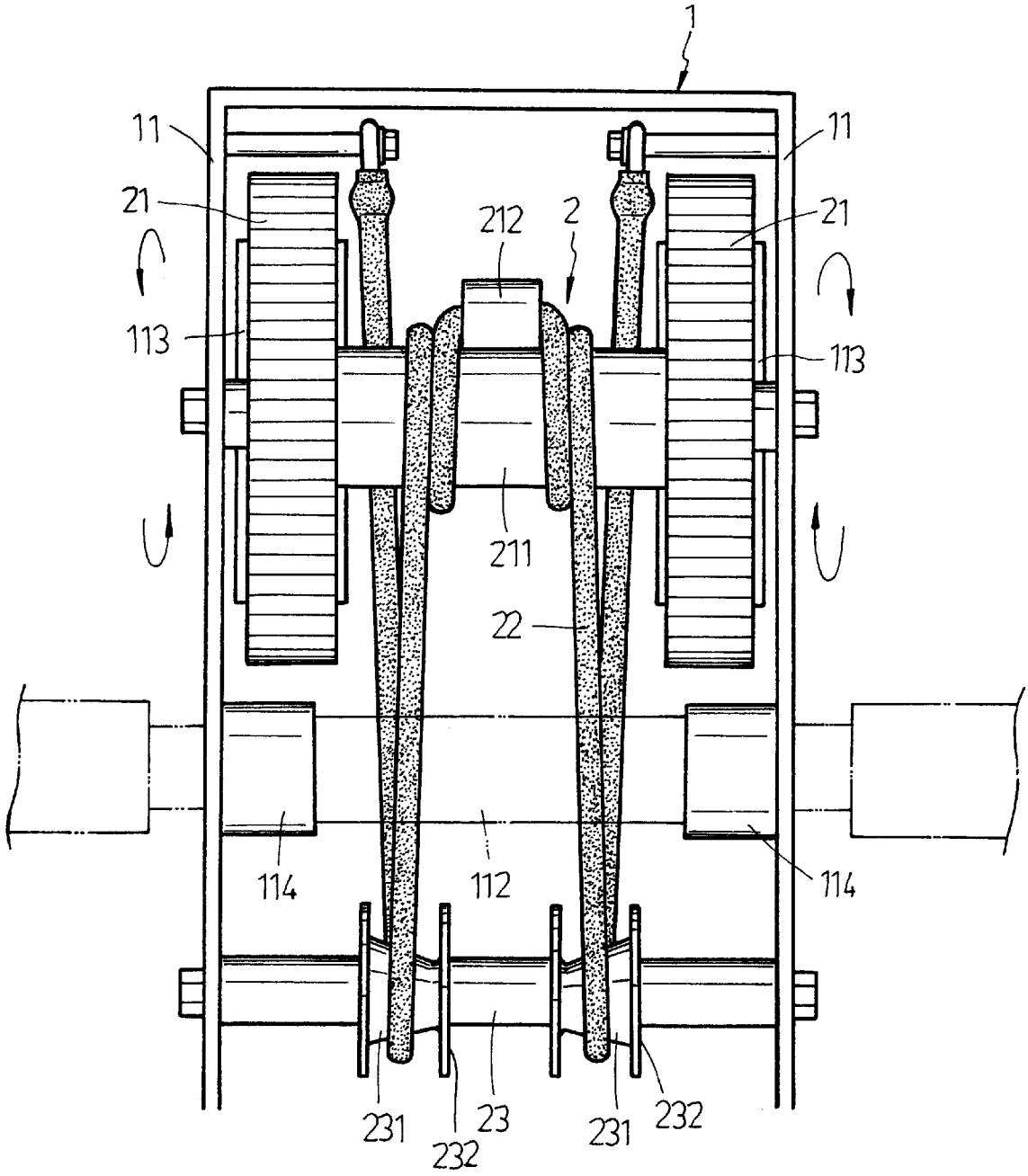
FIG. 5 illustrates the wheel rotated, the elastic cord member rolled up according to the present invention.

Referring to FIGS. 4 and 5, the elastic cord member 22 is set in a W-curve arrangement. When the user alternatively pushes and pulls the handle 112 to move the sliding exerciser back and forth on a flat surface, the elastic cord member 22 is alternatively rolled up and released, i.e., the elastic cord member 22 is rolled up to impart a resistance to the user when the user moves the sliding exerciser forwards on a flat surface; the elastic cord member 22 is released when the user moves the sliding exerciser backwards.

It is to be understood that the drawings are designed for purposes of illustration only, and are not intended for use as a definition of the limits and scope of the invention disclosed.

What the invention claimed is:

1. A sliding exerciser comprising a body unit and a damping unit, said body unit comprising two parallel slots disposed near a rear side thereof, a handle transversely disposed on the middle, bottom wheel holder disposed near a front side thereof, and a castor coupled to said bottom wheel holder, wherein said damping unit comprises two wheels respectively rotated in the parallel slots of said body unit and protruding over a bottom side wall of said body unit for enabling the sliding exerciser to be moved on a flat surface, a wheel axle coupled between said wheels, said wheel axle having an eyed lug on the middle, a revolving shaft coupled between two upright side walls of said body unit, said revolving shaft having two fixed conical wheels, and an elastic cord member inserted through the eyed lug of said wheel axle and wound round said conical wheels of said revolving shaft, said elastic cord member having two distal ends bilaterally connected to a front side of said body unit.

* * * * *